US005595246A

United States Patent [19]

Voll et al.

[11] Patent Number: 5,595,246

[45] Date of Patent: Jan. 21, 1997

[54] ONE TRIP CEMENT AND GRAVEL PACK SYSTEM

[75] Inventors: Benn A. Voll, Houston, Tex.; Matthew S. Kebodeaux, Abita Spring, La.; Steve Stringfellow, Spring, Tex.

[73] Assignee: Baker Hughes Incorporated, Houston, Tex.

[21] Appl. No.: 388,371

[22] Filed: Feb. 14, 1995

[51] Int. Cl.[6] ..... E21B 33/13; E21B 43/04

[52] U.S. Cl. ..... 166/278; 166/131; 166/285

[58] Field of Search ..... 166/285, 278, 166/184, 131

[56] References Cited

U.S. PATENT DOCUMENTS

| | | | |
|---|---|---|---|
| 2,716,454 | 8/1955 | Abendroth | 166/184 X |
| 2,753,940 | 7/1956 | Bonner | 166/184 X |
| 4,187,906 | 2/1980 | Kovacs | 166/120 |
| 4,270,608 | 6/1981 | Hendrickson et al. | 166/278 |
| 4,444,263 | 4/1984 | Ploeg et al. | 166/285 |
| 4,655,286 | 4/1987 | Wood | 166/285 |
| 4,869,323 | 9/1989 | Stagg | 166/285 |
| 5,024,273 | 6/1991 | Coone et al. | 166/285 X |

*Primary Examiner*—Hoang C. Dang
*Attorney, Agent, or Firm*—Rosenblatt & Redano P.C.

[57] ABSTRACT

An apparatus and method is provided that allows an operator to drill a well into a formation requiring treatment or gravel packing in a single pass, then to lower and position the liner and production strings simultaneously. The invention allows cementing of the liner prior to any treatment or gravel packing, and provides an integral circulation system to allow formation treatment or gravel packing of the production string. Once treatment or gravel packing is completed, the invention provides mechanical fluid loss control as the circulation system is pulled out of the hole.

10 Claims, 6 Drawing Sheets

ONE TRIP CEMENT AND GRAVEL PACK SYSTEM

FIELD OF THE INVENTION

The field of the invention is installing and cementing well liners and providing a circulation system for formation treatment, conditioning, or gravel packing.

BACKGROUND OF THE INVENTION

Oil and gas operators often drill wells in formations that require treatment of the producing formation or gravel packing to ensure optimum production. In past installations, such treatment or gravel packing was not attempted until after a well liner was positioned and cemented in place. The liner and its cement seal served to isolate the producing formation, or pay zone, from other zones above the pay zone so that there was no cross-contamination or fluid and material loss during treatment or gravel packing.

Presently, the liner cementing and formation treatment or gravel packing are accomplished as separate steps, requiring multiple equipment runs into the well bore. First, the well bore is drilled to the point where the liner will be seated. The liner is lowered into position and cemented into place. After the cement has set, a second, smaller diameter drill string is used to drill beyond the cemented liner into the pay zone. The drill string is removed and a circulation system is lowered into the pay zone for treatment or gravel packing of the pay zone. This system is expensive and time-consuming because it requires multiple trips in and out of the hole and multiple drilling runs.

In some cases, a single hole can be drilled into the pay zone, and the liner and production strings lowered in a single trip. However, these situations only occur when there is no need to treat the formation or gravel pack the production string, and the production string can utilize large-opening slotted or perforated production casing. The liner can be cemented into position and the well brought on line without multiple trips in and out of the hole because there is little or no danger of formation contamination or debris plugging the production casing. When formation treatment or gravel packing is required, large-opening production casing cannot be used and this simpler, one-pass approach is unavailable due to the danger of formation damage or plugging the small openings in the production screens.

It is an object of this invention to allow a single drilling operation to complete the well bore into the pay zone when formation treatment or gravel packing is required.

It is a further object of this invention to allow simultaneous insertion of cementing apparatus and formation treatment or gravel packing apparatus into the well bore.

It is a further object of this invention to allow cementing operations without danger of contaminating or clogging either the formation or production equipment installed below the cementing apparatus.

SUMMARY OF THE INVENTION

An apparatus and method is provided that allows an operator to drill a well into a formation requiring treatment or gravel packing in a single pass, then to lower, position, and set the drill-in liner and production strings simultaneously. The invention allows cementing of the drill-in liner prior to any treatment or gravel packing, and provides an integral circulation system to allow formation treatment or gravel packing of the production string. Once treatment or gravel packing is completed, the invention provides mechanical fluid loss control as the circulation system is pulled out of the hole.

The invention comprises a liner assembly, a cementing assembly, and a circulation and production assembly. After the well bore has been drilled into the pay zone, the three assemblies are assembled at the surface and lowered into the well bore. The circulation and production assembly includes the shoe and production screens, with a wash pipe inserted into the interior of this string to provide circulation control during formation treatment or gravel packing.

The cementing assembly includes a cementing valve and means of isolating the annulus of the cementing assembly from the annulus of the circulation and production assembly. During cementing operations, the isolation means is used to prevent cement flow down into the pay zone. The bottom of the liner assembly connects to the top of the cementing assembly, so that cement pumped through the cementing assembly is forced upward to encase and seal the liner in position. "Cement" as used herein includes using cement or other means of achieving a seal between liner and the well bore.

Once the cementing operation is completed, the cementing wash pipe is withdrawn and a new wash pipe is lowered into position to connect to the circulation and production assembly wash pipe. Formation treatment or gravel packing is carried out to prepare the well to be brought on line. When the treatment or gravel packing is completed, the entire wash string is withdrawn. Mechanical means, such as a knock out isolation valve, provides mechanical fluid loss control to prevent fluid backwash in the production assembly.

DETAILED DESCRIPTION OF THE PREFERRED EMBODIMENT

Figure 1A:
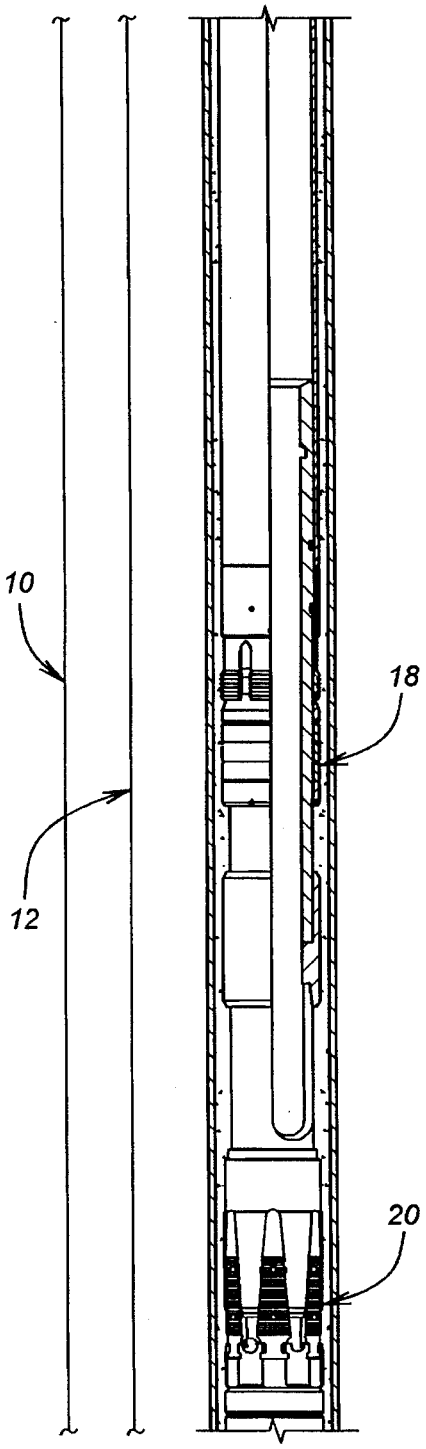
FIGS. 1A–E is a partially cut away drawing of the outer equipment string for one embodiment of the one trip cement and gravel pack system.
Figure 1B:
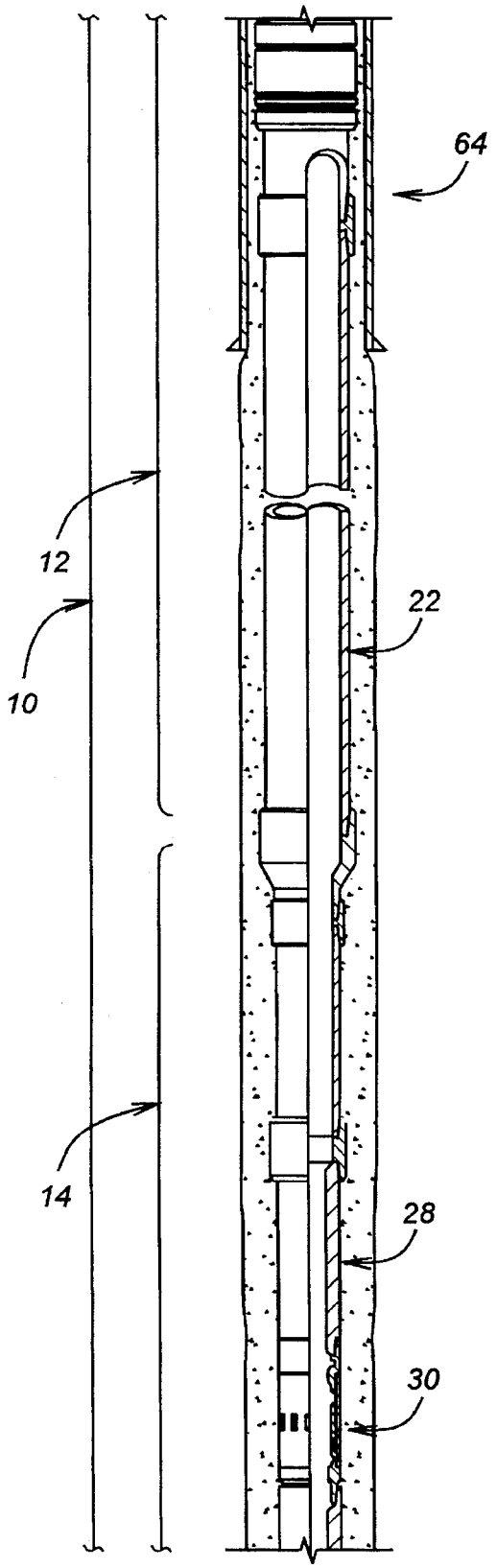
Figure 1C:
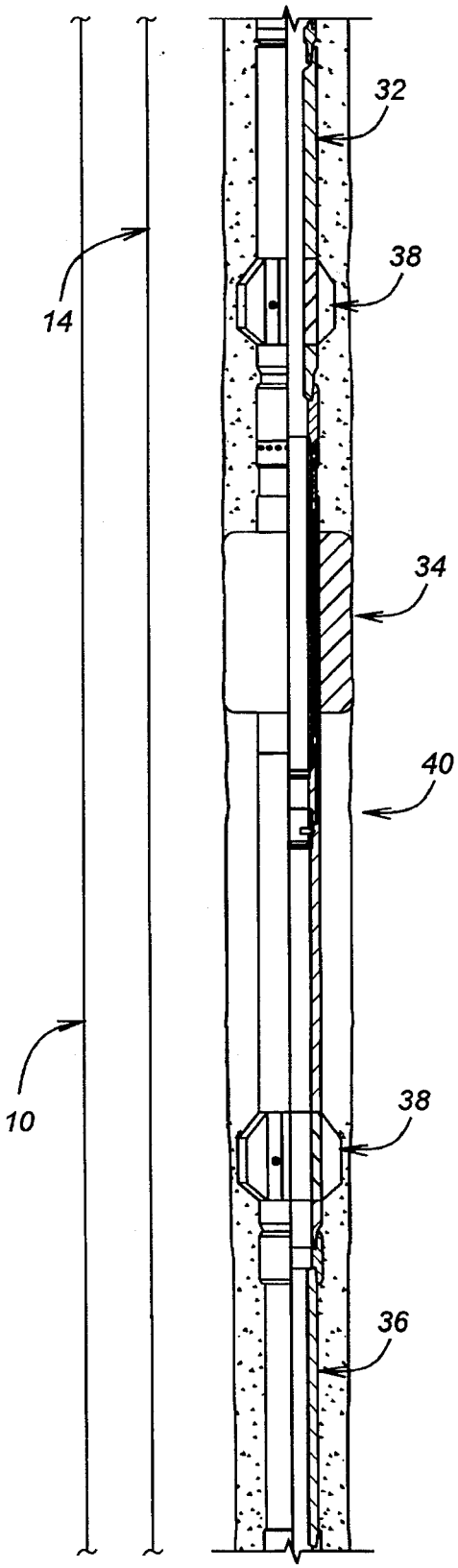
Figure 1D:
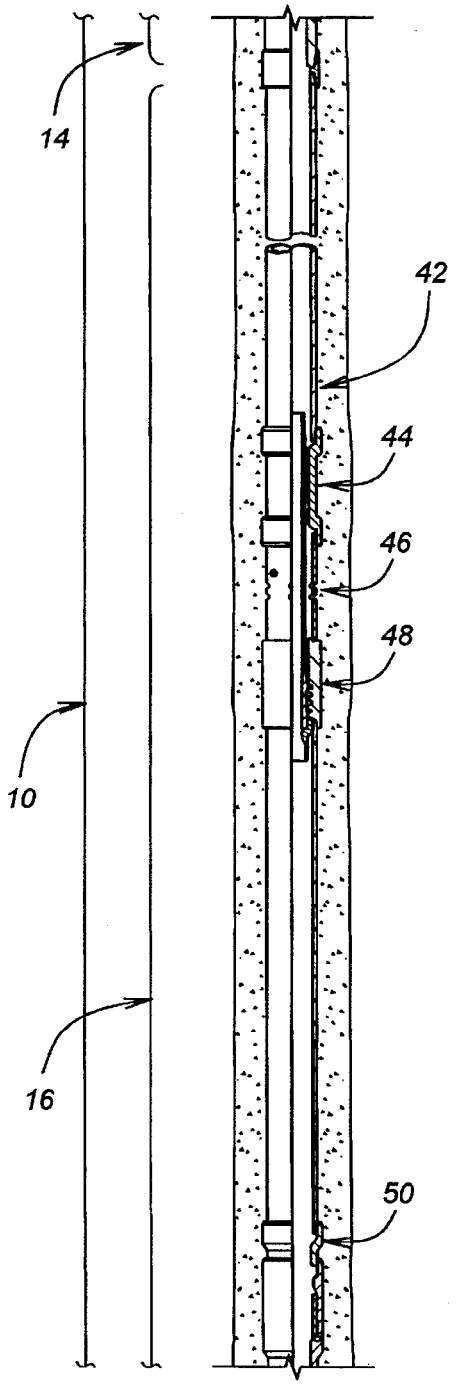
Figure 1E:
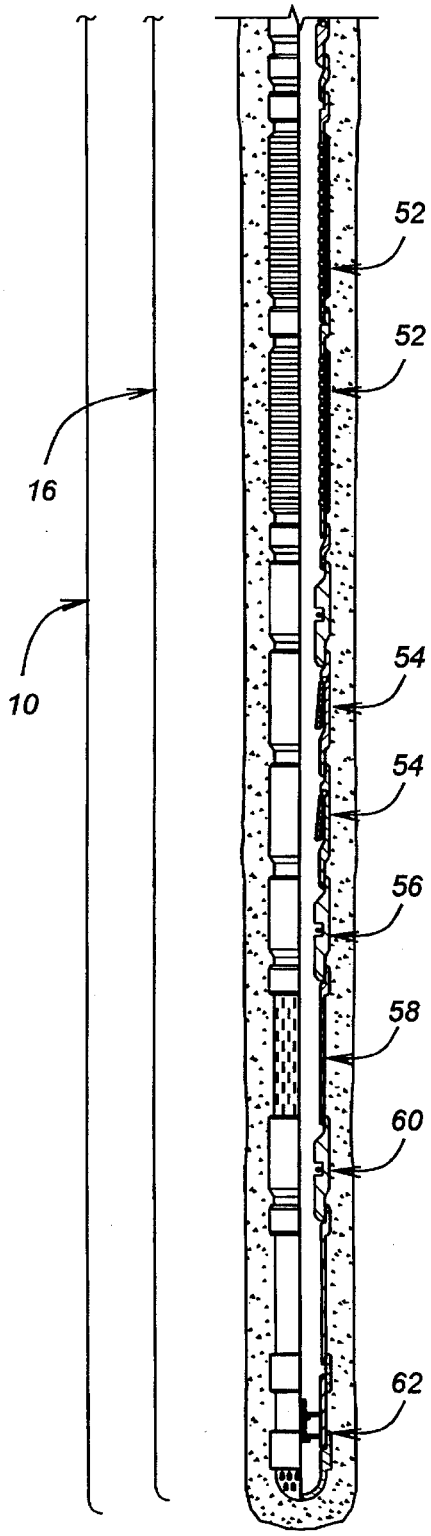

Referring to FIGS. 1A–E, one embodiment of the outer equipment string 10 of the one pass cement and gravel pack system is shown. The outer equipment string 10 comprises an outer liner assembly 12, an outer cementing assembly 14, and an outer circulation assembly 16.

The outer liner assembly 12 comprises a liner packer 18, such as Baker Product No. 296-14, a liner hanger 20, such as Baker Product No. 292-50, and a liner 22. The liner packer 18, the liner hanger 20, and the liner 22 are normally used in lining and cementing operations, and those skilled in the art will recognize that the particular specifications for these will vary depending on the conditions of the installation.

The outer cementing assembly 14 is in fluid communication with the outer liner assembly 12 and comprises a first seal bore extension 28, such as Baker Product No. 449-40, a cementing valve 30, such as Baker Product No. 810-80, a second seal bore extension 32, such as Baker Product No. 449-40, an external casing packer 34, such as Baker Product No. 301-13, and a third seal bore extension 36, such as Baker Product No. 449-40. Slip-on fluted centralizers 38 may be used to position the outer cementing assembly 14 and to protect the external casing packer 34 from premature setting during insertion into the well bore 40.

The outer circulating and production assembly 16 is in fluid communication with the outer cementing assembly 14 and comprises casing joints 42, a seal bore 44, a perforated extension 46, a lower seal bore 48, a knock-out isolation valve 50, pre-pack screens 52, flapper valves 54, a first O-ring seal subassembly 56, a slotted liner 58, a second O-ring seal subassembly 60, and a set shoe 62, such as a double "V" set shoe.

Figure 2A:
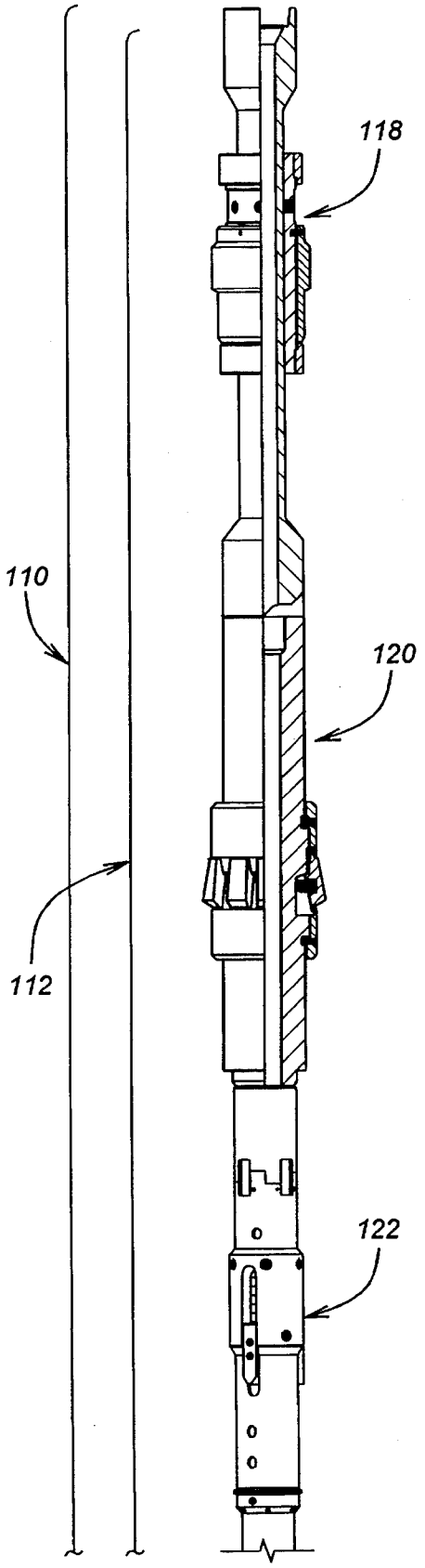
FIGS. 2A–F is a partially cut away drawing of the inner equipment string for one embodiment of the one trip cement and gravel pack system.
Figure 2B:
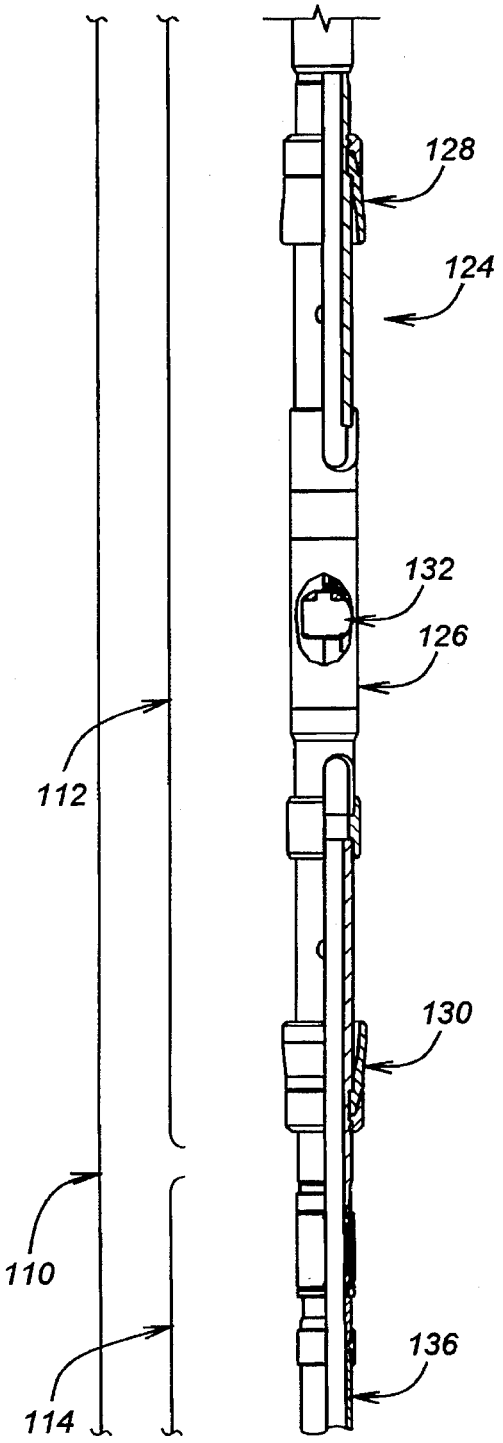
Figure 2C:
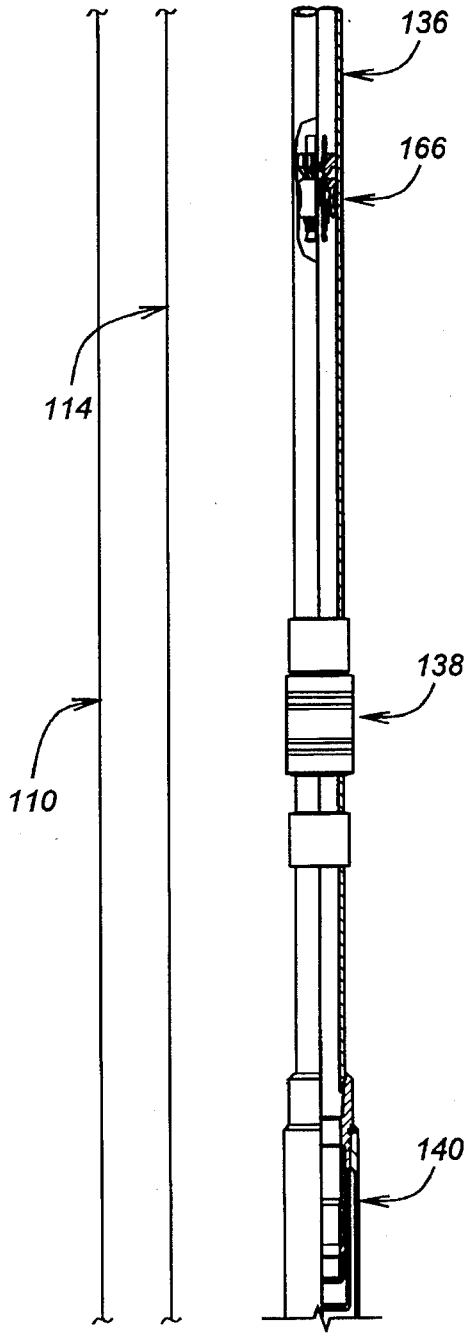
Figure 2D:
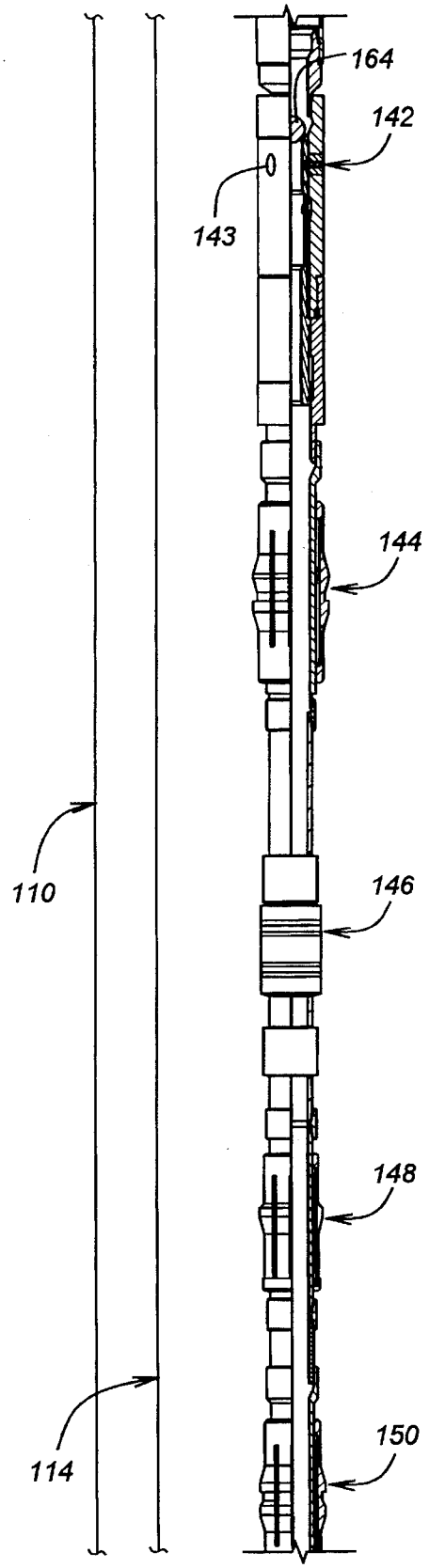
Figure 2E:
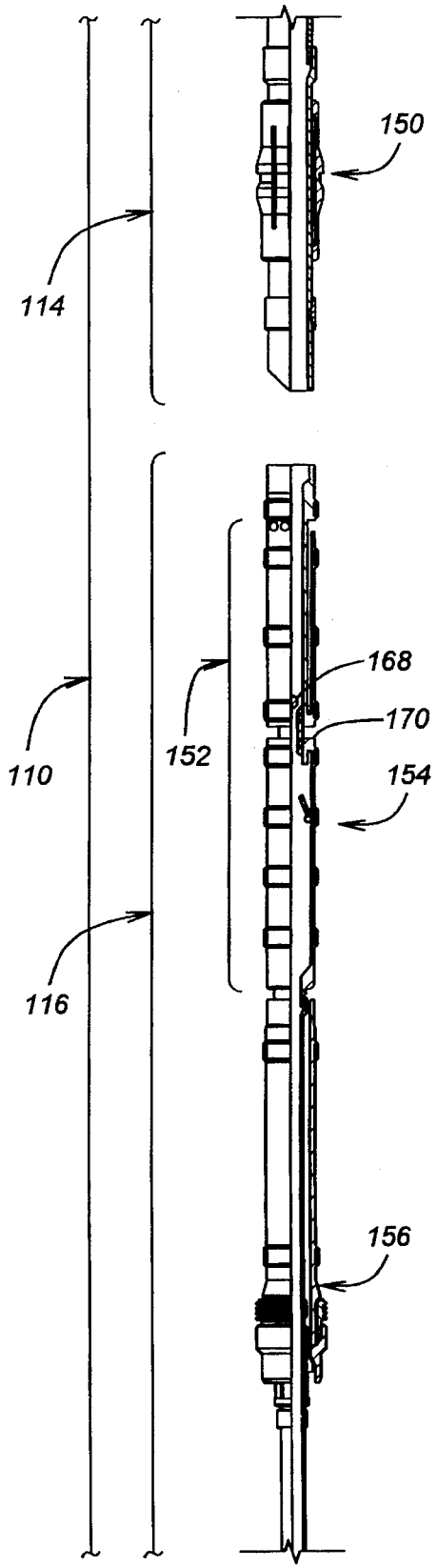
Figure 2F:
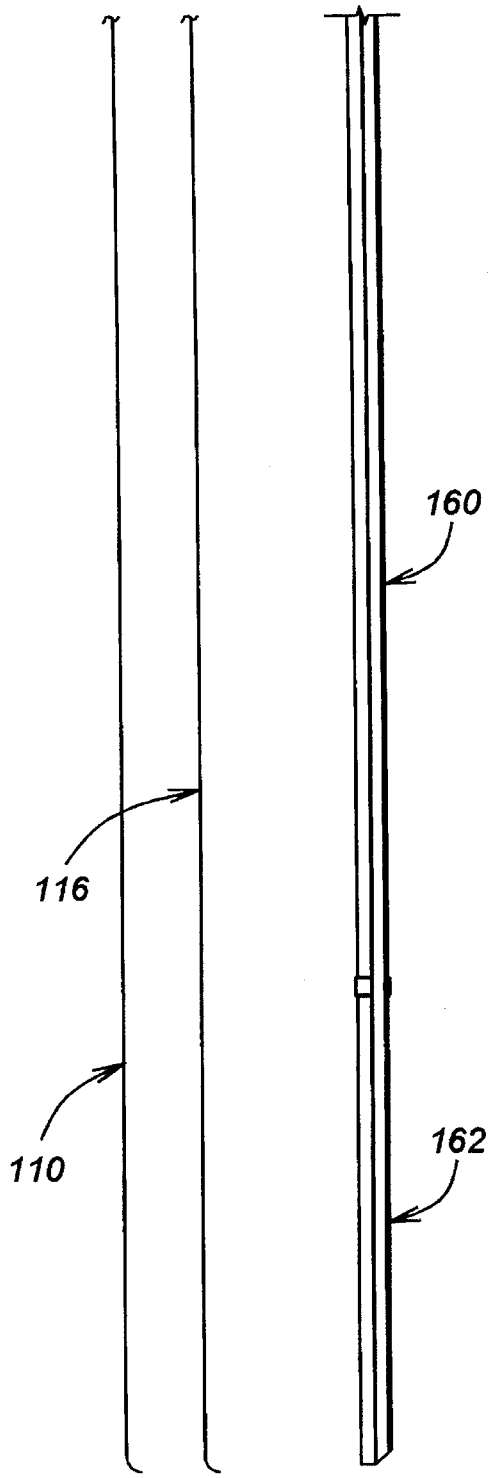

Referring to FIGS. 2A–F, one embodiment of the inner equipment string 110 of the one pass cement and gravel pack system is shown. The inner equipment string comprises an inner liner assembly 112, an inner cementing assembly 114, and an inner circulation assembly 116.

The inner liner assembly 112 comprises a lift nipple 118, such as Baker Product No. 265-20, a packer setting dog subassembly 120, such as Baker Product No. 270-09, a liner setting tool 122 such as Baker Product No. 265-88, a first wash pipe 124, and a ported landing subassembly 126, such as Baker Product No. 276-04. Seals 128 and 130 isolate a port 132 on the ported landing subassembly 126.

The inner cementing assembly 114 is in fluid communication with the inner liner assembly 112 and comprises a second wash pipe 136, a first seal assembly 138, a slurry placement indicator 140, such as a Baker Model "E," Baker Product No. 445-56, a circulating valve 142, such as a Baker Model "S2P," Baker Product No. 445-66, a closing tool 144, such as a Baker Model "HB," a second seal assembly 146, an indicating collet assembly 148, such as Baker Model "A," Baker Product No. 445-34, and an opening tool 150, such as Baker Model "HB."

The inner circulation assembly 116 is installed coaxially with the outer circulation and production assembly 16. The inner circulation assembly 116 comprises a crossover tool 152, such as Baker Product No. 445-72, a low bottom hole pressure flapper valve 154, an anchor seal assembly 156, and a third wash pipe 160.

Referring to FIGS. 1A–E and 2A–F, the well bore 40 is initially drilled to the depth at which the liner 22 is to be begun. The outer casing 64 is lowered into the well bore 40 and cemented into position. The well bore is then completed, drilling to the final position desired in the pay zone. The one trip cementing and gravel pack system is initially assembled at the surface with the inner equipment string 110 coaxial with and inside the outer equipment string 10 and lowered into position so that the set shoe 62 is in the pay zone at the bottom of the well bore 40. A ball 164 is dropped into the well bore 40 so that it will be caught by the ported landing subassembly 126. Once caught, the ball 164 blocks the fluid flow, allowing internal pressure to be built up from the surface. Seals 128 and 130 prevent the fluid from flowing in the annulus between the inner equipment string 110 and the outer equipment string 10. The increased fluid pressure is forced against the liner hanger 20 to set it. After the liner hanger 20 is set, the port 132 in the ported landing subassembly 126 is closed and the ball 164 is released. If the ported landing subassembly 126 is a type such as Baker Product No. 276-04, these actions are accomplished by further increasing the pressure in the inner equipment string 110, forcing the port 132 to close and breaking a shear pin to release the ball 164. The ball 164 is pumped to the circulating valve 142.

The circulating valve 142 must trap the ball and seal off fluid flow from the region below the circulating valve 142. If the circulating valve 142 is a valve such as a Baker "S2P," the ball 164 is caught on a teflon seat. The teflon seat flexes to form a tight seal between the teflon seat and the ball 164, preventing fluid flow into the region below the teflon seat. Several smaller balls are embedded in the teflon seat and act to hold the ball 164 in position. Once the ball 164 is in position against the teflon seat, fluid flow from above the ball is diverted through a circulating valve port 143.

The first seal assembly 138 is initially positioned inside of the third seal bore extension 36. When the ball 164 lands on the teflon seat, the fluid overpressure is prevented from releasing upwards in the inner equipment string 110 by the first seal assembly 138, and is instead forced downward into the inner circulation assembly 116. This positioning protects the external casing packer 34 from damage due to the fluid overpressure.

After the ball 164 is captured, the inner equipment string 110 is raised to position the first seal assembly 138 inside of the second seal bore extension 32, and the second seal assembly 146 inside the third seal bore extension 36. As the inner equipment string 110 is raised, the indicating collet assembly 148 locates onto the third seal bore extension 36, providing a weight indication on the inner equipment string 110 to indicate position. In this position, the circulating valve port 143 is aligned with the external casing packer 34. The external casing packer 34 is pressure set in accordance with the procedure for the specific model used.

When the external casing packer 34 is set, the internal equipment string 110 is again raised, positioning the first seal assembly 138 in the first seal bore extension 28, and the second seal assembly 146 in the second seal bore extension 32. As the inner equipment string 110 is raised, the indicating collet assembly 148 locates onto the second seal bore extension 32, providing a weight indication on the inner equipment string 110 to indicate position. In this position, the circulating valve port 143 is aligned with the cementing valve 30. Cement is pumped through the cementing valve 30 to fill the annulus between the liner 22 and the well bore 40. If the inner equipment string 110 is raised too far, the cementing valve 30 may be accidentally closed. If the cementing valve 30 is accidentally closed, the inner equipment string 110 may be raised further to use the opening tool 150 to reopen the cementing valve 30.

The slurry placement indicator 140, such as Baker Model "E," comprises a seat and a bypass. When the last of the cement is pumped into the well bore 40 at the surface, a wiper plug 166, such as Baker Product No. 445-56 is pumped on top of the cement and followed with completion fluid to force the cement through the circulating valve port 143. When it reaches the slurry placement indicator 140, the wiper plug 166 seats in the seat of the slurry placement indicator 140, causing a temporary rise in pressure at the surface to notify the surface crew of the location of the wiper plug 166. The increase in pressure forces the bypass in the slurry placement indicator 140 to open, relieving the pressure increase and allowing completion of the cementing operation.

When the cementing operation is completed, the inner equipment string 110 is again raised to use the closing tool 144 to close the cementing valve 30. After pressure testing to insure proper closure of the cementing valve 30, the inner equipment string 110 is lowered until the packer setting dog subassembly 120 engages the liner packer 18. Weight is applied to the inner equipment string 110 to set the liner packer 18.

After the completion of the cementing operation and setting the liner packer 18, the inner liner assembly 112 and the inner cementing assembly 114 of the inner equipment string 110 are raised sufficiently to allow reverse circulation to clean out any excess cement. The inner liner assembly 112 and the inner cementing assembly 114 are then pulled out of the well bore 40. The removed inner liner assembly 112 and the inner cementing assembly 114 may be replaced with a wash pipe which can be connected to the inner circulation assembly 116 for formation treatment or gravel packing operations.

To treat the formation or gravel pack in preparation for production, a wash pipe is run back into the well and engaged onto the inner circulation assembly 116 using conventional fishing equipment. A second ball 168 is dropped into the well bore 40 and is caught by the crossover tool 152. Once caught, the second ball 168 blocks fluid flow in the interior of the inner circulation assembly 116, causing an increase in liquid pressure. The increased pressure exposes the gravel pack port 170.

If the crossover tool 152 is a valve such as Baker "S2P," the second ball 168 is caught on a teflon seat. The teflon seat flexes to form a tight seal between the teflon seat and the second ball 168, preventing fluid flow into the region below the teflon seat. Several smaller balls are embedded in the teflon seat and act to hold the second ball 168 in position. Once the second ball 168 is in position against the teflon seat, fluid flow from above the ball is diverted through the gravel pack port 170.

The crossover tool 152 is initially positioned between the seal bore 44 and the lower seal bore 48, so that fluid flowing out of the crossover tool 152 flows out of the perforated extension 46 and downward into the pay zone, across the knockout isolation valve 50, pre-pack screens 52, flapper valves 54, first O-ring seal subassembly 56 and into the slotted liner 58. The fluid returns up the third wash pipe 160, through the by-pass in the crossover tool 152, and returns to the surface. This circulating position allows fluids to be pumped across the pay zone to treat or gravel pack as required.

Once sufficient circulation is achieved, the inner circulation assembly 116 is raised, pulling the anchor seal assembly 156 into the seal bore 44 and the lower seal bore 48, thereby isolating the perforated extension 46. In this position, the gravel pack port 170 is above the seal bore 44, allowing excess fluids to be reversed or circulated out of the well bore 40.

After the completion of treatment or gravel packing, inner circulation assembly 116 is separated from the anchor seal assembly 156. The inner circulation assembly 116, without the anchor seal assembly 156, is withdrawn from the well bore 40, leaving the anchor seal assembly 156 in position so that it permanently isolates the perforated extension 46.

As the inner circulation assembly 116 is removed, the knock-out isolation valve drops 50 into position to prevent the fluid in the inner circulation assembly 116 from flooding into the outer circulation and production assembly 16.

We claim:

1. A method of well completion comprising:

drilling a well bore;

running into the well bore an assembly comprising a liner, equipment for cementing said liner, and equipment for treating, conditioning, or gravel packing the portion of the formation adjacent the lower end of said assembly, wherein said assembly further comprises an inner equipment string such that said inner equipment string initially comprises an inner circulation assembly;

isolating a zone outside said assembly into an upper and a lower region;

cementing at least a part of said upper region;

selectively disconnecting said inner circulation assembly from the remainder of said inner equipment string;

removing said inner equipment string from the well bore without removing said inner circulation assembly;

connecting a wash pipe to said inner circulation assembly; and treating, conditioning, or gravel packing the lower region of the formation.

2. The method of claim 1, additionally comprising:

controlling fluid flow in said inner circulation assembly by selectively positioning at least a portion of said inner circulation assembly within said equipment for treating, conditioning, or gravel packing the formation.

3. The method of claim 1, additionally comprising:

holding a one way valve open by said inner circulation assembly;

removing said inner circulation assembly from the well bore; and allowing said one way valve to close to prevent further flow of fluid from said inner circulation assembly back into the well bore as said inner circulation assembly is removed.

4. The method of claim 1, additionally comprising:

setting a liner hanger to initially position said liner prior to performing said cementing step.

5. The method of claim 4, additionally comprising:

inflating a packer in the well bore external to said assembly adjacent the boundary between said equipment for cementing said liner and said equipment for treating, conditioning, or gravel packing the formation to provide fluid isolation between said upper region and said lower region.

6. The method of claim 5, additionally comprising:

controlling fluid flow in said inner circulation assembly by selectively positioning at least a portion of said inner circulation assembly within said equipment for treating, conditioning, or gravel packing the formation.

7. The method of claim 6, additionally comprising:

holding a one way valve open by said inner circulation assembly;

removing said inner circulation assembly from the well bore; and allowing said one way valve to close to prevent further flow of fluid from said inner circulation assembly back into the pay zone as said inner circulation assembly is removed.

8. A method of well completion comprising:

drilling a well bore;

running into the well bore an assembly comprising a liner, equipment for cementing said liner, and equipment for treating, conditioning, or gravel packing the portion of the formation adjacent the lower end of said assembly;

isolating a zone outside said assembly into an upper and a lower region;

cementing at least a part of said upper region;

providing fluid communication from said cemented liner to said lower region via said equipment for treating, conditioning, or gravel packing the formation;

treating, conditioning, or gravel packing the lower region of the formation; and controlling the position of an inner equipment string comprising an orifice to control fluid flow through said equipment for cementing said liner.

9. The method of claim 8, additionally comprising:

directing fluid flow in said inner equipment string by selectively obstructing a fluid pathway within said inner equipment string.

10. A device for liner cementing and gravel packing or formation treatment of a well bore, comprising:

a liner assembly, defining an annulus between its exterior and the well bore;

a cementing assembly connected to and in fluid communication with said liner assembly, defining a continuation of said annulus between the exterior of said cementing assembly and the well bore; and a circulation and production assembly connected to said cementing assembly, defining a further continuation of said annulus between the exterior of said circulation and production assembly and the well bore;

said cementing assembly further comprises a sealing device capable of dividing said annulus into an upper region and a lower region, said cementing assembly selectively providing fluid communication with said upper region of said annulus and simultaneous fluid isolation of said lower region of said annulus and said circulation and production assembly during cementing of said upper region, or selectively providing fluid communication from said liner assembly to said lower region of said annulus and said circulation and production assembly, for subsequent downhole operations; and said cementing assembly comprises at least one seal bore and an internal pipe having a lateral outlet selectively positionable in said seal bore for actuating said sealing device.

* * * * *

UNITED STATES PATENT AND TRADEMARK OFFICE

Certificate

Patent No. 5,595,246 Patented: January 21, 1997

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Benn A. Voll, Houston, Tex.; Matthew S. Kebodeaux, Abita Spring, Tex.; Steve Stringfellow, Spring, Tex.; and Christian F. Bayne, The Woodlands, Tex.

Signed and Sealed this Twenty-ninth Day of December, 1998.

TAMARA L. GRAYSAY
*Supervisory Patent Examiner*
Art Unit 3672